US009227446B2

(12) United States Patent
Hobo et al.

(10) Patent No.: US 9,227,446 B2
(45) Date of Patent: Jan. 5, 2016

(54) BELT CLEANING DEVICE AND IMAGE FORMING APPARATUS

(71) Applicant: KYOCERA Document Solutions Inc., Osaka (JP)

(72) Inventors: Jumpei Hobo, Osaka (JP); Masami Fujihara, Osaka (JP); Hidenori Takenaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/444,076

(22) Filed: Jul. 28, 2014

(65) Prior Publication Data

US 2015/0035922 A1 Feb. 5, 2015

(30) Foreign Application Priority Data

Jul. 30, 2013 (JP) ..... 2013-157787

(51) Int. Cl.

| | |
|---|---|
| ***G03G 15/20*** | (2006.01) |
| ***G03G 21/00*** | (2006.01) |
| ***B41J 29/17*** | (2006.01) |
| ***B41J 11/00*** | (2006.01) |

(52) U.S. Cl.

CPC ..... *B41J 29/17* (2013.01); *B41J 11/007* (2013.01)

(58) Field of Classification Search

USPC ..... 399/71, 101, 99, 121, 123, 303, 357, 399/390

See application file for complete search history.

(56) References Cited

U.S. PATENT DOCUMENTS

| | | | | |
|---|---|---|---|---|
| 5,564,337 | A * | 10/1996 | Uehara et al. | 101/408 |
| 7,454,149 | B2 * | 11/2008 | Sakamaki | 399/50 |
| 7,590,368 | B2 * | 9/2009 | Kamijo et al. | 399/101 |
| 7,593,664 | B2 * | 9/2009 | Okabe | 399/101 |
| 7,764,899 | B2 * | 7/2010 | Kurosu | 399/99 |
| 8,699,898 | B2 * | 4/2014 | Kikuchi et al. | 399/44 |
| 2009/0123205 | A1 * | 5/2009 | Watanabe et al. | 399/350 |

FOREIGN PATENT DOCUMENTS

| | | | |
|---|---|---|---|
| JP | 2004-137032 | A | 5/2004 |
| JP | 2010-107797 | A | 5/2010 |
| JP | 2011-095674 | A | 5/2011 |
| JP | 2012-189727 | A | 10/2012 |

OTHER PUBLICATIONS

An Office Action; "Notice of Reasons for Rejection," issued by the Japanese Patent Office on Oct. 13, 2015, which corresponds to Japanese Patent Application No. 2013-157787 and is related to U.S. Appl. No. 14/444,076.

* cited by examiner

*Primary Examiner* — Anh T. N. Vo
(74) *Attorney, Agent, or Firm* — Studebaker & Brackett PC

(57) ABSTRACT

A belt cleaning device includes a cleaning roller. The cleaning roller includes a roller having an outer peripheral surface. A sheet-like cleaning element is wound to the outer peripheral surface of the roller. One end part of the cleaning element is fixed to the outer peripheral surface of the roller. Both side edge parts in the other end part of the cleaning element are fixed to the outer peripheral surface of the roller. The both side edge parts in the other end part of the cleaning element are located on the outside of their region that is to face to possibly largest paper.

13 Claims, 7 Drawing Sheets

BELT CLEANING DEVICE AND IMAGE FORMING APPARATUS

INCORPORATION BY REFERENCE

The present application claims priority under 35 U.S.C. §119 to Japanese Patent Application No. 2013-157787, filed Jul. 30, 2013. The contents of this application are incorporated herein by reference in their entirety.

BACKGROUND

The present disclosure relates to belt cleaning devices and image forming apparatuses.

Inkjet recording apparatuses are widely employed in printers, copiers, multifunction peripherals, etc. because of their compactness, low price, low operating sound, etc. An inkjet recording apparatus ejects ink droplets from a plurality of nozzles provided at a recording head to form an image on a recording medium (e.g., copier paper).

An inkjet recording apparatus of some type forms an image in a manner that the nozzles eject ink droplets toward a recording medium loaded on and conveyed by a conveyance belt.

When a jam (paper jam) or the like occurs in the inkjet recording apparatus having such a configuration, ink may adhere to the conveyance belt to contaminate a recording medium that is conveyed next.

SUMMARY

The first aspect of the present disclosure presents a belt cleaning device to clean a conveyance belt that conveys a recording medium, which includes a cleaning roller. The cleaning roller includes a roller having an outer peripheral surface, and a sheet-like cleaning element wound to the outer peripheral surface of the roller. The cleaning element is wound to the outer peripheral surface of the roller in a circumferential direction with one end part thereof fixed to the roller. The other end part thereof is fixed in a part thereof other than a region thereof that is to face a possible largest recording medium.

The second aspect of the present disclosure presents an image forming apparatus including a conveyance belt configured to convey a recording medium, a belt cleaning device configured to clean the conveyance belt, and an image forming section configured to form an image on the recording medium. The belt cleaning device includes a cleaning roller. The cleaning roller includes a roller having an outer peripheral surface, and a sheet-like cleaning element wound to the outer peripheral surface. The cleaning element is wound to the outer peripheral surface of the roller in a circumferential direction with one end part thereof fixed to the roller. The other end part thereof is fixed in a part thereof other than a region thereof that is to face a possible largest recording medium.

DETAILED DESCRIPTION

Figure 1:
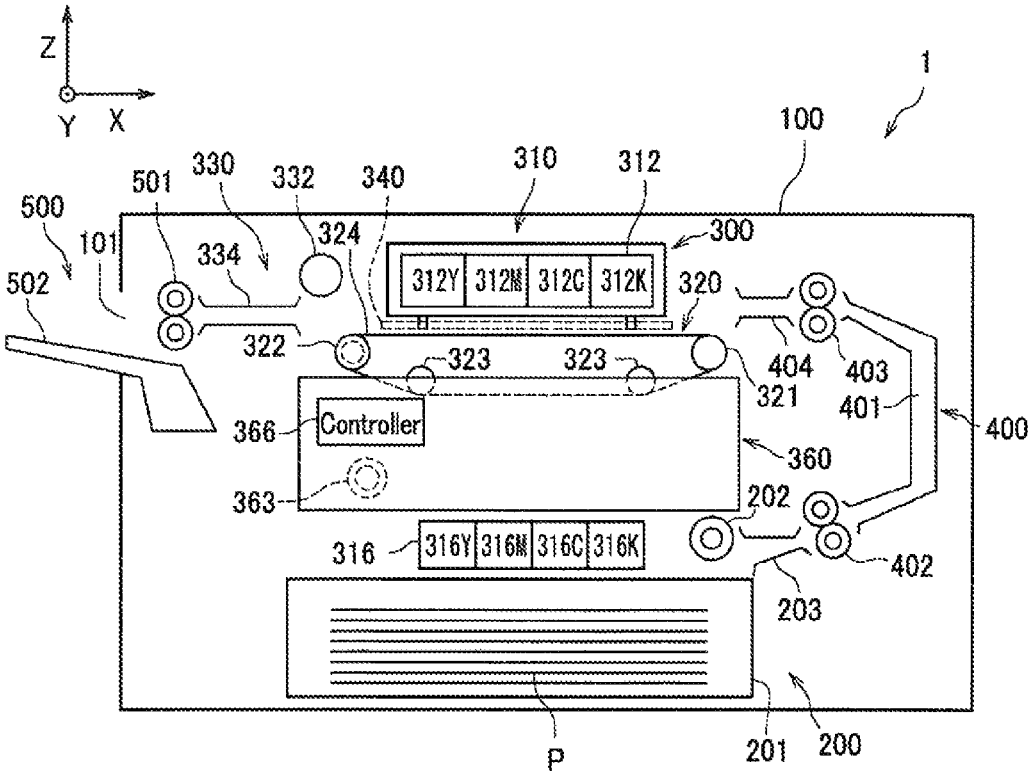
FIG. 1 is an illustration schematically showing a configuration of an inkjet recording apparatus including a belt cleaning device according to the present disclosure.

Embodiments of the present disclosure will be described below with reference to the accompanying drawings. FIG. 1 is an illustration schematically showing a configuration of an inkjet recording apparatus 1 including a belt cleaning device according to the present disclosure.

As shown in FIG. 1, the inkjet recording apparatus 1 includes an apparatus casing 100, a paper feed section 200 arranged in the lower part of the apparatus casing 100, an image forming section 300 of inkjet recording type arranged above the paper feed section 200, a paper conveyance section 400 arranged on one side of the image forming section 300, and a paper ejecting section 500 arranged on the other side of the image forming section 300.

The paper feed section 200 includes a paper feed cassette 201 detachable from the apparatus casing 100, a paper feed roller 202, and a pair of guide plates 203. The paper feed roller 202 is arranged above one side end of the paper feed cassette 201. The guide plates 203 are arranged between the paper feed roller 202 and the paper conveyance section 400.

Plural sheets of paper P as a recording medium are accommodated so as to be stacked in the feed cassette 201. The paper feed roller 202 takes out the paper P accommodated in the paper feed cassette 201 on a sheet-by-sheet basis. The guide plates 203 guide the paper P taken out by the paper feed roller 202 to the paper conveyance section 400.

The paper conveyance section 400 includes a substantially C-shaped paper conveyance path 401, a conveyance roller pair 402 provided on the inlet side of the paper conveyance path 401, a registration roller pair 403 provided on the outlet side of the paper conveyance path 401, and a pair of guide plates 404 provided between the registration roller pair 403 and the image forming section 300.

The conveyance roller pair 402 pinches the paper P fed from the paper feed section 200 and sends it out to the paper conveyance path 401. The registration roller pair 403 performs skew correction on the paper P supplied from the paper conveyance path 401. Then, the registration roller pair 403 temporarily keeps the paper P for synchronization of printing timing with conveyance of the paper P, and then sends it out to the guide plates 404 with the printing timing. The guide plates 404 guide the paper P sent out by the registration roller pair 403 to the image forming section 300.

The image forming section 300 includes a recording section 310, a conveyance unit 320, a drying section 330, a nozzle cleaner 340, and a lifting unit 360.

The recording section 310 includes a head portion 312 and a tank unit 316 arranged below the lifting unit 360.

The conveyance unit 320 includes a support roller 321, a drive roller 322, a pair of tension rollers 323, a conveyance belt 324, and a suction unit (not shown).

The conveyance belt 324 is endless and is wound to surround the support roller 321, the drive roller 322, and the tension rollers 323. A plurality of through holes (not shown) are formed to pass through the conveyance belt 324 in its thickness direction.

Inside the suction unit, a suction member is provided, such as a fan, a vacuum pump, etc. When the suction member is driven, a negative pressure is generated inside the suction unit. The negative pressure acts on the paper P supported on one side of the conveyance belt 324 through the through holes of the conveyance belt 324, so that the paper P is sucked on the conveyance belt 324.

The drive roller 322 is spaced apart from the support roller 321 in a paper conveyance direction. The drive roller 322 is driven to rotate by a motor (not shown) to rotate the conveyance belt 324 in a first direction that is the paper P conveyance direction and a second direction opposite to the first direction. The tension rollers 323 are arranged below and between the support roller 321 and the drive roller 322 to apply a tension to the conveyance belt 324.

The head portion 312 includes four recording heads 312K, 312C, 312M, and 312Y respectively corresponding to colors of black, cyan, magenta, and yellow. The recording heads 312K, 312C, 312M, and 312Y are arranged side by side from the upstream side to the downstream side in the paper conveyance direction in this order.

The tank unit 316 includes four ink tanks 316K, 316C, 316M, and 316Y arranged side by side from the upstream side to the downstream side of the paper conveyance direction in this order.

The recording heads 312K, 312C, 312M, and 312Y each include a plurality of nozzles arranged in the width direction (Y direction) of the conveyance belt 324. The recording heads 312K, 312C, 312M, and 312Y are of line head type. For example, each of the recording heads 312K, 312C, 312M, and 312Y of line head type is fixed to the apparatus casing 100.

Each of the nozzles of the recording head 312K communicates with a pressure chamber (not shown) formed in the recording head 312K. The pressure chamber communicates with an ink chamber (not shown) formed in the recording head 312K. The ink chamber communicates with an ink supply pump (not shown). The ink supply pump communicates with the ink tank 316K.

Each of the nozzles of the recording head 312C communicates with a pressure chamber (not shown) formed in the recording head 312C. The pressure chamber communicates with an ink chamber (not shown) formed in the recording head 312C. The ink chamber communicates with an ink supply pump (not shown). The ink supply pump communicates with the ink tank 316C.

Each of the nozzles of the recording head 312M communicates with a pressure chamber (not shown) formed in the recording head 312M. The pressure chamber communicates with an ink chamber (not shown) formed in the recording head 312M. The ink chamber communicates with an ink supply pump (not shown). The ink supply pump communicates with the ink tank 316M.

Each of the nozzles of the recording head 312Y communicates with a pressure chamber (not shown) formed in the recording head 312Y. The pressure chamber communicates with an ink chamber (not shown) formed in the recording head 312Y. The ink chamber communicates with an ink supply pump (not shown). The ink supply pump communicates with the ink tank 316Y.

The recording heads 312K, 312C, 312M, and 312Y eject ink to the paper P conveyed by the conveyance belt 324 to form an image on the paper P.

The drying section 330 includes a dryer 332 and a pair of guide plates 334.

The dryer 332 blows hot wind to the paper P to dry ink droplets ejected on the paper P from the head portion 312. It is noted that the drying section 330 may be dispensed with. For example, according to the type of the ink or the like, the drying section 330 may be omitted if it is unnecessary to dry ink with the use of the drying section 330.

The guide plates 334 guide the paper P sent out by the conveyance unit 320 to the paper ejecting section 500.

The nozzle cleaning device 340 is lifted up and down in the Z direction accompanied by lifting up and down of the conveyance unit 320 by the lifting unit 360, and moves horizontally in the X direction by a horizontal movement mechanism (not shown).

By a movement operation of the horizontal movement mechanism, the nozzle cleaning device 340 can selectively take a wipe position or a standby position. The wipe position is a position where the recording heads 312K, 312C, 312M, and 312Y are capable of being cleaned, and the standby position is distant from the wipe position in the horizontal direction. The nozzle cleaning device 340 moves to the standby position before image formation and moves to the wipe position before nozzle cleaning.

The paper ejecting section 500 includes an ejection roller pair 501 and an exit tray 502. The exit tray 502 is fixed to the apparatus casing 100 to protrude outward from an exit port 101 formed in the apparatus casing 100.

After passing through the dryer 332, the paper P is sent out toward the exit port 101 by the ejection roller pair 501, and then is guided by the exit tray 502 to be ejected outside the apparatus casing 100 through the exit port 101.

Figure 2:
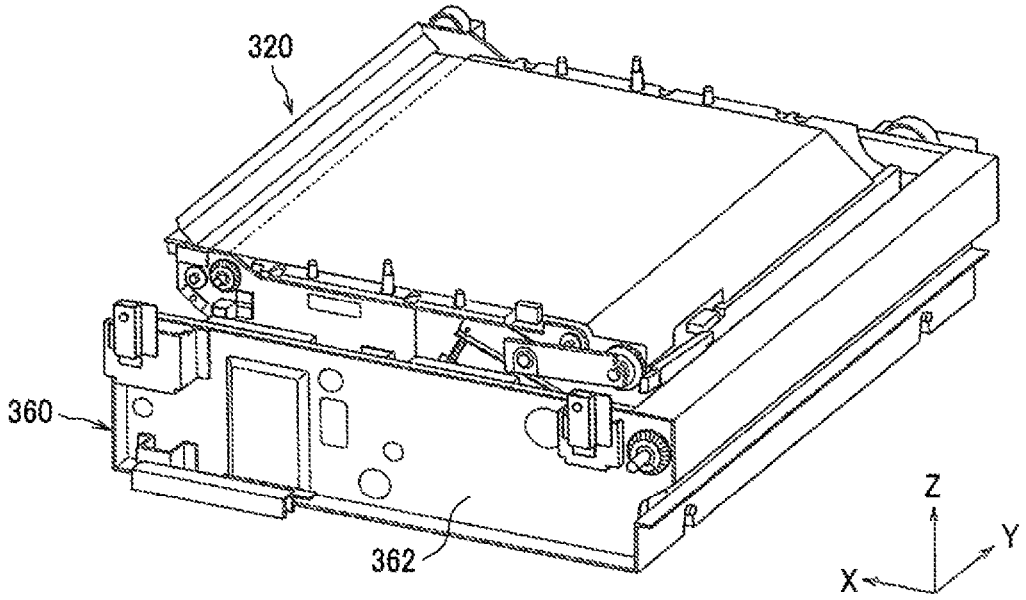
FIG. 2 is a perspective view of a conveyance unit and a lifting unit provided in the inkjet recording apparatus shown in FIG. 1.

FIG. 2 is a perspective view of the conveyance unit 320 and the lifting unit 360 provided in the inkjet recording apparatus 1 shown in FIG. 1.

The lifting unit 360 includes a lifting unit main body 362, a lifting section (not shown) to lift up and down the conveyance unit 320, a lifting detecting section (not shown) to detect the position of the lifting section, a cleaning roller 363 (see FIG. 1), and a controller 366 (see FIG. 1). The lifting unit 360 functions as a belt cleaning device according to the present disclosure.

The cleaning roller 363 is rotatable in the same direction as the first direction and the same direction as the second direction by a motor (not shown). Here, the words, "the cleaning roller 363 rotates in the same direction as the first direction", for example, means that the rotation direction of a part of the cleaning roller 363 which is in contact with the conveyance belt 324 is the same as the first direction. In this case, the rotation direction of the motor that drives to rotate the cleaning roller 363 is a direction opposite to the rotation direction of the motor that drives the conveyance belt 324 in the first direction.

The controller 366 is a microcomputer including a CPU, a ROM, and a RAM. The CPU executes predetermined processing in accordance with a program stored in the ROM. The controller 366 controls the motor for the drive roller 322 and the motor for the cleaning roller 363 according to information output from the lifting detecting section.

Figure 3A:
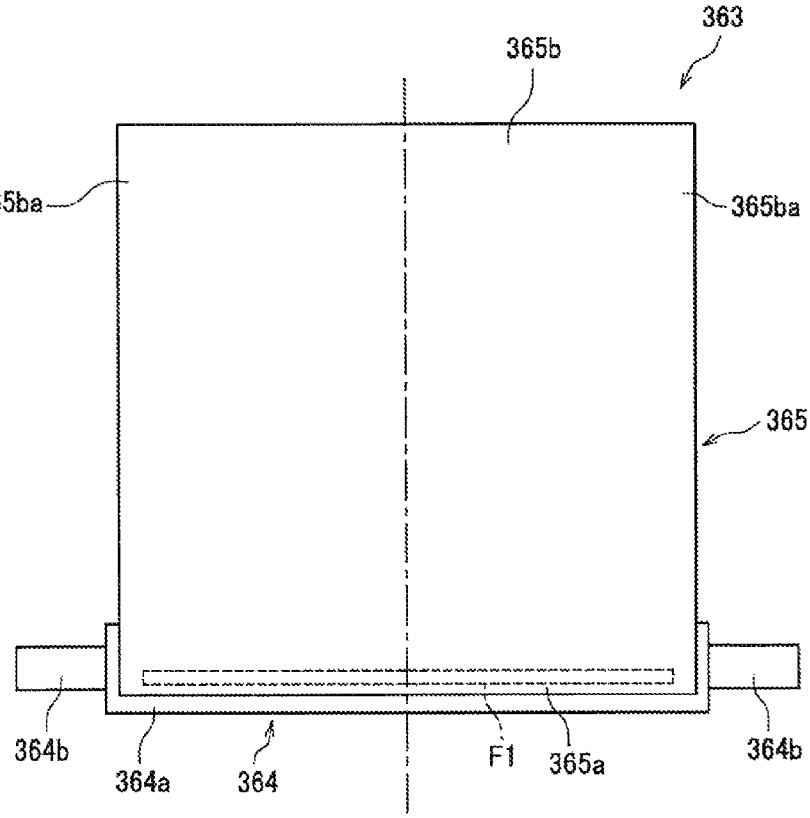
FIG. 3A is a side view of a cleaning roller used in the belt cleaning device according to the first embodiment and illustrates a state before a cleaning element is wound to the roller.
Figure 3B:
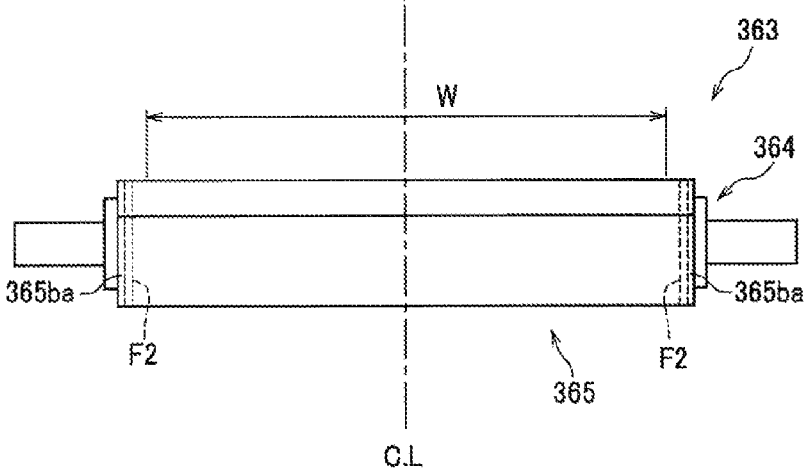
FIG. 3B is a side view of the cleaning roller used in the belt cleaning device according to the first embodiment and illustrates a state after the cleaning element is wound to the roller.

The configuration of the cleaning roller 363 will be described next in detail with reference to FIGS. 3A and 3B. FIGS. 3A and 3B are side views of the cleaning roller 363 according to the first embodiment. FIG. 3A illustrates a state before a cleaning element 365 is wound to a roller 364. FIG. 3B illustrates a state after the cleaning element 365 is wound to the roller 364.

As shown in FIGS. 3A and 3B, the cleaning roller 363 includes the roller 364 having an outer peripheral surface 364*a* and the cleaning element 365 wound to the outer peripheral surface 364*a* of the roller 364. The roller 364 is made from metal, resin, or the like and includes support shafts 364*b* protruding in the axial direction from the opposite end faces of the roller 364.

The cleaning element 365 is formed from a single piece of a sheet material. Preferably, the sheet material is excellent in liquid absorbability and has a low friction coefficient. A sheet member having a low friction coefficient can prevent degradation of the conveyance belt 324 and the cleaning roller 363 and can reduce rubbing noise generated between the cleaning roller 363 and the conveyance belt 324. Examples of the material of the cleaning element 365 include nonwoven fabric, cloth, paper, a porous member having continuous air holes, and the like.

In the case where non-woven fabric is used as the material of the cleaning element 365, the use of non-woven fabric having fibers liable to fall off may lead to contamination of the inside of the image forming apparatus. Accordingly, it is preferable to use, as the material of the cleaning element 365, nonwoven fabric having fibers that hardly fall off and excellent in liquid absorbability. An example of such nonwoven fabric may be GS felt (K10021M (trade name) manufactured by Toray Industries, Inc.) as a polyester/polyurethane nonwoven fabric.

Layers formed by winding the cleaning element 365 to the roller 364 need to be thick to some extent in order to ensure necessary cleaning power. In the case of helical winding, a cleaning element is helically wound to the outer peripheral surface of a roller, while being shifted in the axial direction of the roller. Therefore, the cleaning element cannot be wound in a manner to be overlaid several times. Accordingly, in the case where an available sheet material forming the cleaning element is small in thickness from the viewpoint of liquid absorbability and/or abrasion resistance, the helical winding may result in insufficient thickness of the layers formed by the cleaning element. By contrast, according to the present disclosure, the cleaning element 365 is wound to the outer peripheral surface 364*a* of the roller 364 in the circumferential direction, so that the cleaning element 365 can be wound and overlaid several times. Thus, the thickness of the layers formed by the cleaning element 365 can be increased sufficiently.

For example, the cleaning roller 363 can be obtained in a manner that the cleaning element 365 of nonwoven fabric with a thickness of 0.3 mm and a length in the winding direction of 380 mm is wound about seven times to the roller 364 with a diameter of 16 mm. By doing so, the cleaning roller 363 has an outer diameter of about 20 mm, and the layers formed by the cleaning element 365 have a thickness of about 2 mm.

The cleaning element 365 is wound to the outer peripheral surface 364*a* of the roller 364 in the following manner. As shown in FIG. 3A, one end part 365*a* of the cleaning element 365 is fixed to the outer peripheral surface 364*a* of the roller 364 through a fixing portion F1 such as a bonding agent, a double sided tape, or the like provided on the reverse surface of the one end part 365*a*. The cleaning element 365 in this state is wound to the outer peripheral surface 364*a* of the roller 364 in the circumferential direction. Then, both side edge parts 365*ba*, that is, parts in the vicinity of the two opposite sides (right and left sides in FIG. 3A) in the other end part 365*b* of the cleaning element 365 are fixed to the outermost layer of the cleaning element 365 located under the other end part 365*b* through a fixing portion F2 provided on the reverse surface of each both side edge part 365*ba* in the other end part 365*b*. A bonding agent or a double sided tape may be used as the fixing portion F2, for example. It is noted that the both side edge parts 365*ba* may be fixed entirely to the layers of the cleaning element 365 located thereunder. Alternatively, the both side edge parts 365*ba* may be fixed partly to the layers of the cleaning element 365 located thereunder.

The other end part 365*b* of the cleaning element 365 is fixed in a part of the cleaning element 365 other than a region thereof which is to face paper P having a maximum size that the conveyance belt 324 is capable of conveying (the largest paper, for example, A3 size paper on which the inkjet recording apparatus 1 is capable of forming an image). In other words, when supposed that the width of the largest paper P in the direction orthogonal to the conveyance direction is W, the region of the cleaning element 365 which is to face the largest paper P is a region of the width W with a center line C.L of the cleaning element 326 as a center (see FIG. 3B). The fixing portion F2 is provided in a part except this region.

Figure 4A:
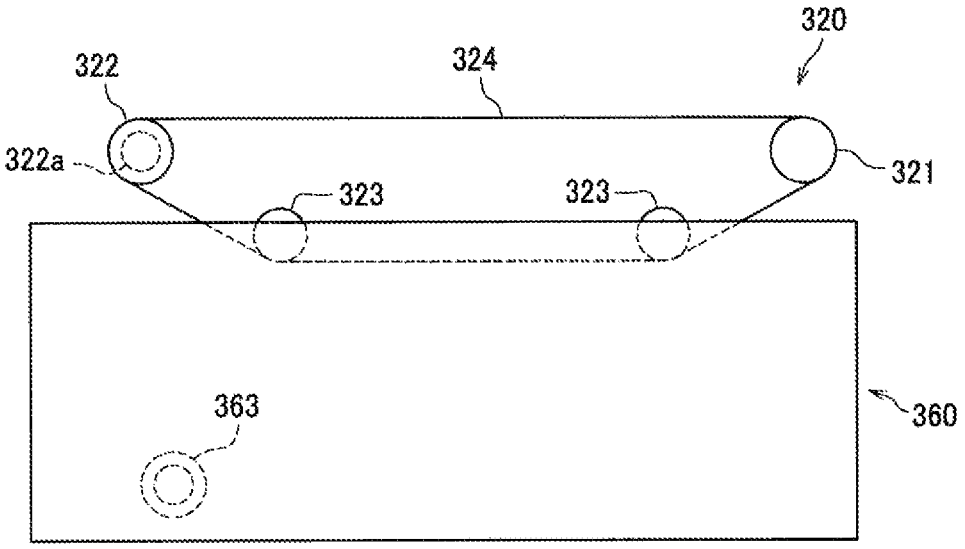
FIG. 4A is an explanatory drawing showing operations of the conveyance unit and the lifting unit shown in FIG. 2 and illustrates a state in which the conveyance unit is positoned at an image forming position.
Figure 4B:
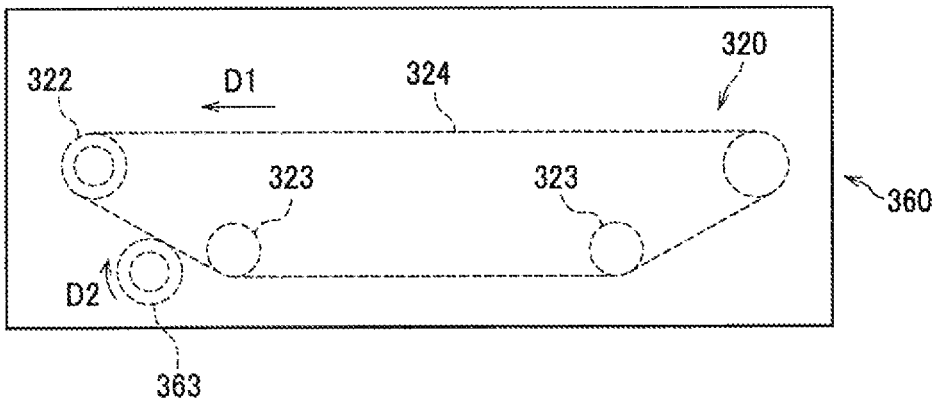
FIG. 4B is an explanatory drawing showing the operations of the conveyance unit and the lifting unit shown in FIG. 2 and illustrates a state in which the conveyance unit is positoned at a cleaning position.

An operation and advantages of the first embodiment will be described next. FIGS. 4A and 4B are explanatory drawings showing operations of the conveyance unit 320 and the lifting unit 360 shown in FIG. 2. FIG. 4A shows a state in which the conveyance unit 320 is positioned at an image forming position. FIG. 4B shows a state in which the conveyance unit 320 is positioned at a cleaning position.

In image formation, the recording heads 312K, 312C, 312M, and 312Y of the head portion 312 (see FIG. 1) eject ink to the paper P, and the dryer 332 (see FIG. 1) dries the ink on the paper P, thereby forming an image on the paper P. In image formation, the conveyance belt 324 is driven in the first direction (direction indicated by the arrow D1).

Upon occurrence of a jam or the like in image formation, ink may adhere to the surface of the conveyance belt 324 on which paper P is to be loaded. Paper P to be conveyed next may be contaminated with the adhering ink, or the ink may cause any other defects. Under the circumstance, the conveyance belt 324 needs to be cleaned periodically or as needed.

In cleaning, when an instruction to start belt cleaning is input through the operation panel (not shown), the lift portion of the lifting unit 360 is brought down to move the conveyance unit 320 downward. Then, as shown in FIG. 4B, when the conveyance unit 320 reaches the cleaning position, the lifting detecting section detects the conveyance unit 320, and the lift portion stops.

As shown in FIG. 4B, the outer peripheral surface of the cleaning roller 363 is in press contact with the surface of the conveyance belt 324 on which paper P is to be loaded. Then, the motor for the drive roller 322 is driven to drive the conveyance belt 324 in the direction indicated by the arrow D1. Then, the motor for the cleaning roller 363 is driven to rotate the cleaning roller 363 in the direction indicated by the arrow D2. The cleaning element 365 (see FIGS. 3A and 3B) of the cleaning roller 363 wipes off foreign matter such as ink adhering to the conveyance belt 324. It is noted that the conveyance belt 324 may be rotated in the opposite direction to the direction indicated by the arrow D1, while the cleaning roller 363 may be rotated in the direction indicated by the arrow D2.

The cleaning element 365 has a width larger than the width of the largest paper P and is wound to the outer peripheral surface 364*a* of the roller 364 in the circumferential direction. Accordingly, the surface region of the cleaning element 365 which is to come in contact with the conveyance belt 324 comes in contact with the entire surface region of the conveyance belt 324 on which the paper P is to be loaded. As a result, reduction in cleaning power can be prevented which may be caused due to the presence of a gap formed between the side parts of the cleaning element as in the case where a band-shaped cleaning member is helically wound to the roller. Further, with such a gap formed between the side parts of the cleaning element, the hems of the side parts of the cleaning element may receive stress from the conveyance belt to be worn out in an earlier stage. However, such a drawback can be reduced with the cleaning roller 363. Thus, the cleaning power and the durability of the cleaning roller 363 can be increased.

Besides, since the other end part 365*b* of the cleaning element 365 is fixed in the region (both side edge parts 365*ba*) other than the region that is to face the largest paper P (region of the width W), reduction in liquid absorbability, which is due to the presence of the fixing portion F2, can be prevented. Specifically, the bonding agent or the double sided tape serving as the fixing portion F2 may inhibit liquid immersion at a part of the outermost layer of the cleaning element 365 which faces the fixing portion F2, thereby reducing the liquid absorbability. However, with the cleaning roller 363, the part of the outermost layer of the cleaning element 365 which faces the fixing portion F2 is located on the outside of the largest paper P that the conveyance belt 324 is to convey in the direction of width W. The part of the outermost layer of the cleaning element 365 which faces the fixing portion F2 faces the conveyance belt 324 and will not face any paper P. Therefore, liquid hardly passes through this part. Thus, reduction in the liquid absorbability of the cleaning element 365, which is due to the presence of the fixing portion F2, can be prevented.

It is noted that in the present embodiment, the rotation direction D2 of the roller 364 in cleaning the conveyance belt 324 accords with a direction in which the cleaning element 365 is wound to the roller 364. By doing so, the cleaning element 365 can hardly come off from the roller 364, thereby increasing the durability.

The second embodiment of the present disclosure will be described next with reference to FIGS. 5A and 5B. It is noted that in the second embodiment, the same reference numerals are used for elements corresponding to those in the first embodiment, and duplicate description will be omitted.

Figure 5A:
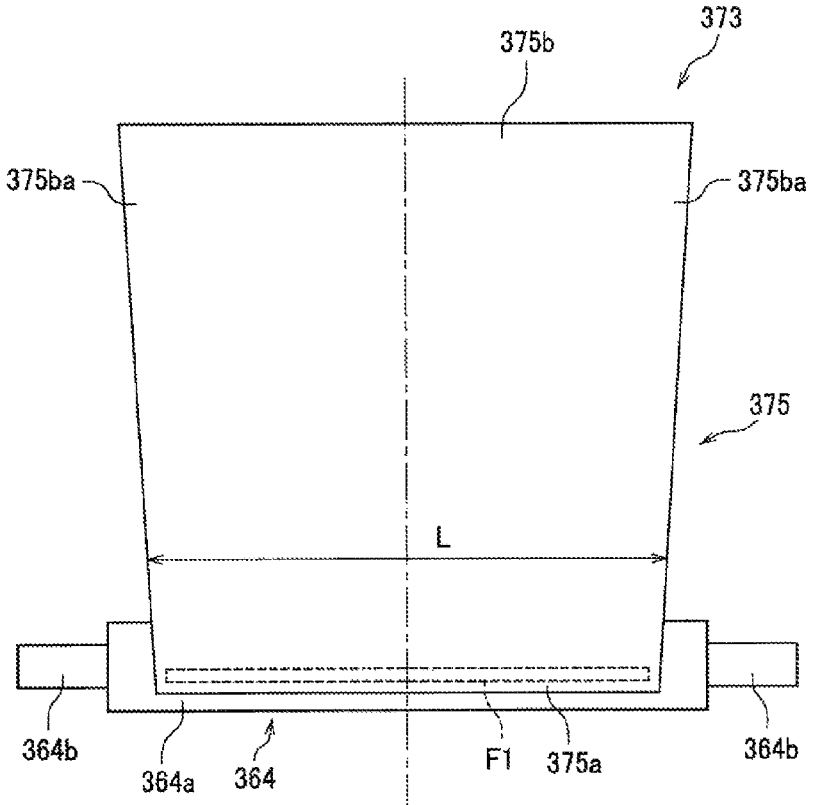
FIG. 5A is a side view of a cleaning roller used in a belt cleaning device according to the second embodiment and illustrates a state before a cleaning element is wound to the roller.
Figure 5B:
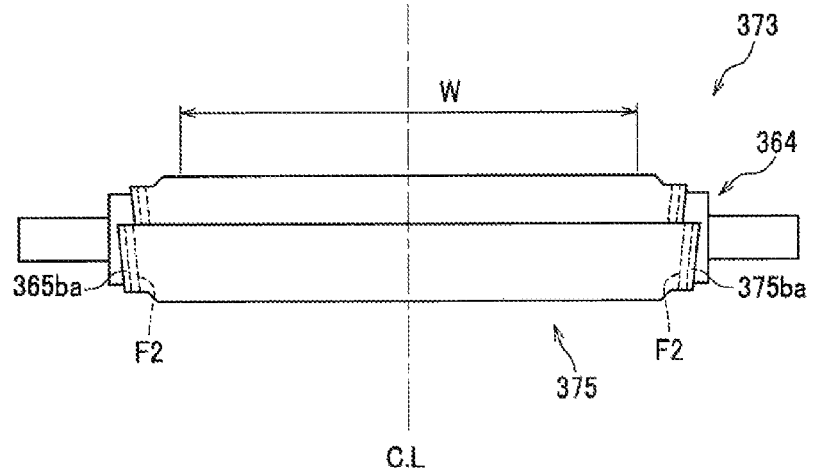
FIG. 5B is a side view of the cleaning roller used in the belt cleaning device according to the second embodiment and illustrates a state after the cleaning element is wound to the roller.

FIGS. 5A and 5B are side views of a cleaning roller 373 used in a belt cleaning device according to the second embodiment. FIG. 5A illustrates a state before the cleaning element 375 is wound to the roller 364. FIG. 5B illustrates a state after the cleaning element 375 is wound to the roller 364.

The cleaning element 375 of a cleaning roller 373 of the present embodiment is trapezoidal in shape. Specifically, a length L of the cleaning element 375 in the axial direction of the roller 364 increases as it goes from one end part 375*a* to the other end part 375*b*.

After the one side part 375*a* of the cleaning element 375 is fixed to the outer peripheral surface 364*a* of the roller 364 through the fixing portion F1, the cleaning element 375 is wound to the outer peripheral surface 364*a* of the roller 364 in the circumferential direction. Then, both side edge parts 375*ba*, that is, parts in the vicinity of the two opposite sides (right and left sides in FIG. 5A) in the other end part 375*b* of the cleaning element 375 are fixed to the outer peripheral surface 364*a* of the roller 364 through the fixing portion F2. It is noted that the both side edge parts 375*ba* may be entirely or partly fixed to the outer peripheral surface 364*a* of the roller 364.

The both side edge parts 375*ba* in the other end part 375*b* of the cleaning element 375 are directly fixed to the roller 364 in the present embodiment. Accordingly, the both side edge parts 375*ba* in the other end part 375*b* of the cleaning element 375 can be fixed more firmly and stably than those in the first embodiment. Specifically, in the first embodiment shown in FIGS. 3A and 3B, the both side edge parts 365*ba* in the other end part 365*b* of the cleaning element 365 are fixed to the layer of the cleaning element 365 located thereunder. By contrast, the both side edge parts 375*ba* in the other end part 375*b* of the cleaning element 375 in the present embodiment are fixed to the roller 364 having higher rigidity than the cleaning element 375. Accordingly, in the present embodiment, the both side edge parts 375*ba* in the other end part 375*b* of the cleaning element 375 can be fixed more firmly and stably than those in the first embodiment. As a result, the both side edge parts 375*ba* can more hardly come off and can have higher durability than those in the first embodiment.

Besides, the both side edge parts 375*ba* in the other end part 375*b* of the cleaning element 375 are fixed to the roller 346 in a fashion to be recessed inward in the radial direction of the roller 364 relative to the region of the cleaning element 375 which is to face the largest paper P (the region of the width W shown in FIG. 5B). Accordingly, the both side edge parts 375*ba* in the vicinity of the other end part 375*b* of the cleaning element 375 are out of contact with the conveyance belt 324, so that the cleaning element 375 can hardly come off from the roller 364. Thus, the cleaning roller 373 has higher durability than the cleaning roller 363.

The third embodiment of the present disclosure will be described next with reference to FIGS. 6A and 6B. It is noted that in the third embodiment, the same reference numerals are used for elements corresponding to those in the first embodiment, and duplicate description will be omitted.

Figure 6A:
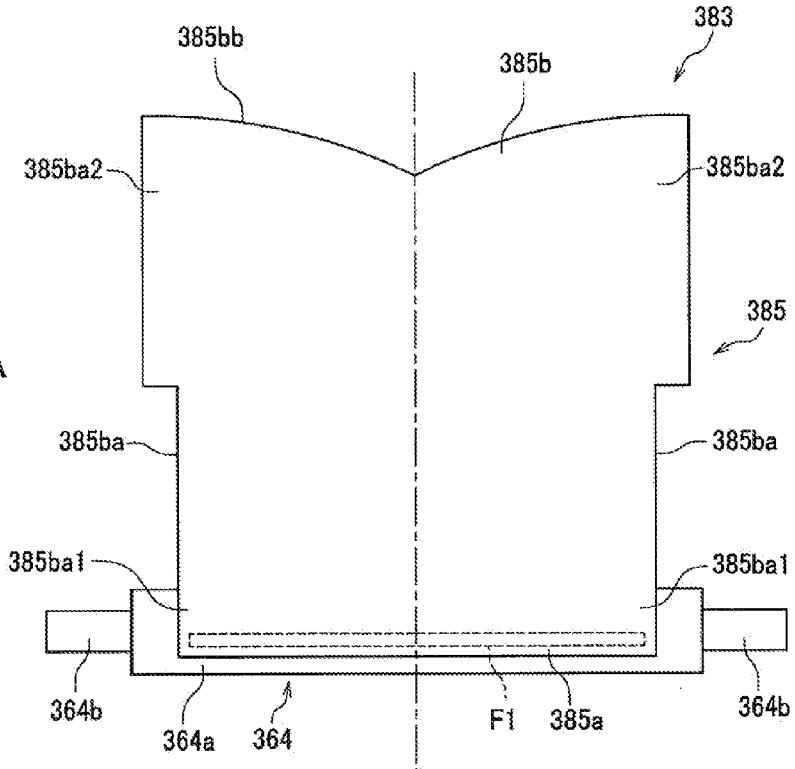
FIG. 6A is a side view of a cleaning roller used in a belt cleaning device according to the third embodiment and illustrates a state before a cleaning element is wound to the roller.
Figure 6B:
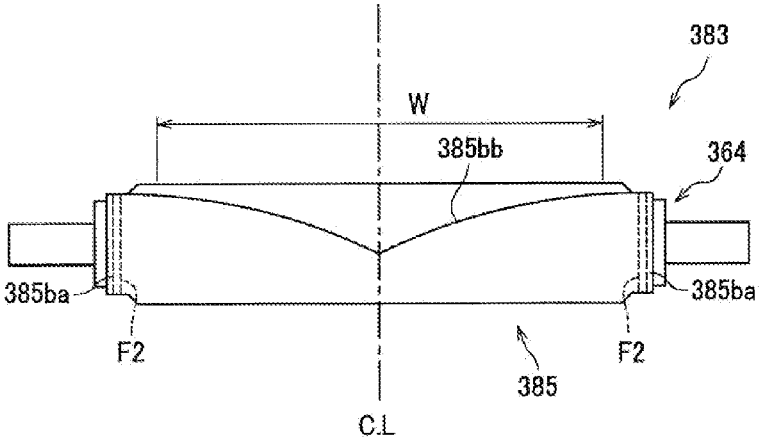
FIG. 6B is a side view of the cleaning roller used in the belt cleaning device according to the third embodiment and illustrates a state after the cleaning element is wound to the roller.

FIGS. 6A and 6B are side views of a cleaning roller 383 used in a belt cleaning device according to the third embodiment. FIG. 6A illustrates a state before a cleaning element 385 is wound to the roller 364. FIG. 6B illustrates a state after the cleaning element 385 is wound to the roller 364.

In the cleaning roller 383 according to the present embodiment, both side edge parts 385*ba*, that is, parts in the vicinity of the two opposite sides (right and left sides in FIG. 6A) of the cleaning element 385 each include a side edge part 385*ba*1 in the vicinity of one end part 385*a* of the cleaning element 385 and a side edge part 385*ba*2 in the vicinity of the other end part 385*b* of the cleaning element 385. The respective side edge parts 385*ba*2 protrude in the axial direction of the roller 364 when compared with the respective side edge parts 385*ba*1. Further, the other end part 385*b* of the cleaning element 385 has a tip edge 385*bb* that is bent in shape. The tip edge 385*bb* is in a gull wing shape as a combination of a pair of arc shaped curves.

After the one end part 385*a* of the cleaning element 385 is fixed to the outer peripheral surface 364*a* of the roller 364 through the fixing portion F1 provided on the reverse surface of the one end part 385*a*, the cleaning element 385 is wound to the outer peripheral surface 364*a* of the roller 364 in the circumferential direction. Then, the respective side edge parts 385*ba*2 in the other end part 385*b* of the cleaning element 385 are fixed to the outer peripheral surface 364*a* of the roller 364 through the fixing portion F2 provided on the reverse surface of each side edge part 385*ba*2. It is noted that each side edge part 385*ba*2 may be entirely or partly fixed to the outer peripheral surface 364*a* of the roller 364.

The both side edge parts 385*ba* in the other end part 385*b* of the cleaning element 385 are directly fixed to the roller 364 having higher rigidity than the cleaning element 385 in the present embodiment. Thus, in the present embodiment, the both side edge parts 385*ba* in the other end part 385*b* of the cleaning element 385 can be fixed more firmly and stably than those in the first embodiment, and can accordingly have higher durability than those in the first embodiment.

Moreover, the both side edge parts 385*ba*2 in the other end part 385*b* of the cleaning element 385 are fixed to the roller 364 in a fashion to be recessed inward in the radial direction of the roller 364 relative to the region of the cleaning element 385 which is to face the largest paper P (the region in the width W shown in FIG. 6B). Accordingly, the both side edge parts 385*ba*2 in the other end part 385*b* of the cleaning element 385 are out of contact with the conveyance belt 324, and therefore, can hardly come off from the roller 364. Thus, the cleaning roller 383 has higher durability than the cleaning roller 363.

Besides, in the present embodiment, the tip edge 385*bb* of the other end part 385*b* of the cleaning element 385 is bent in shape, and therefore can hardly rise up outward in the radial direction of the roller 364 with the other end part 385*b* fixed to the roller 364. Specifically, with the tip edge 385*bb* bent in shape, a force pulling the central part of the bent tip edge 385*bb* toward its both side edges works. For this reason, the tip edge 385*bb* can hardly rise up. Thus, the other end part 385*b* of the cleaning element 385 can be prevented from turning up.

The fourth embodiment of the present disclosure will be described next with reference to FIGS. 7A-7C. It is noted that in the fourth embodiment, the same reference numerals are used for elements corresponding to those in the first embodiment, and duplicate description will be omitted.

Figure 7A:
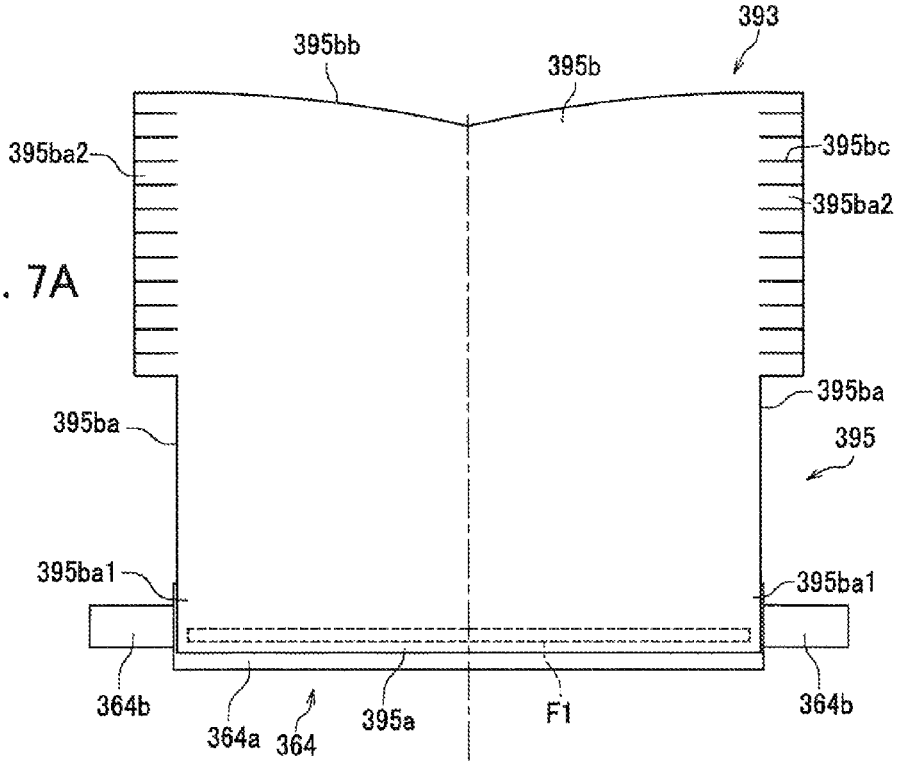
FIG. 7A is a side view of a cleaning roller used in a belt cleaning device according to the fourth embodiment and illustrates a state before a cleaning element is wound to the roller.
Figure 7B:
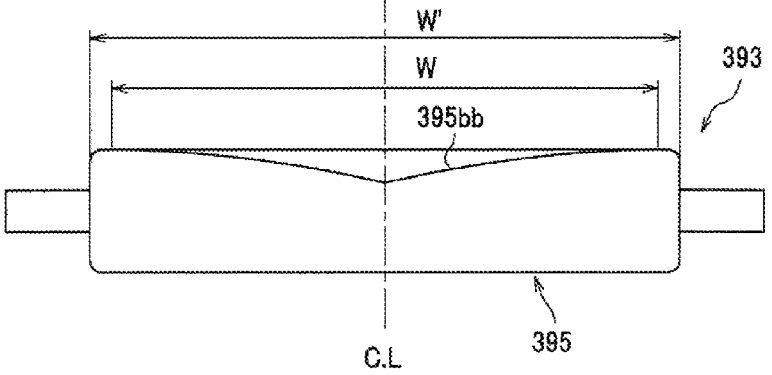
FIG. 7B is a side view of the cleaning roller used in the belt cleaning device according to the fourth embodiment and illustrates a state after the cleaning element is wound to the roller.
Figure 7C:
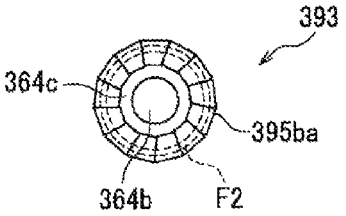
FIG. 7C is a left end side view of the cleaning roller used in the belt cleaning device according to the fourth embodiment.

FIGS. 7A-7B and 7C are side views and an end view, respectively, of a cleaning roller 393 used in a belt cleaning device according to the fourth embodiment. FIG. 7A illustrates a state before a cleaning element 395 is wound to the roller 364. FIG. 7B illustrates a state after the cleaning element 395 is wound to the roller 364. FIG. 7C is a left end view of the cleaning roller 393 shown in FIG. 7B.

Both side edge parts 395*ba*, that is, parts in the vicinity of the two opposite sides (right and left sides in FIG. 7A) of the cleaning roller 393 according to the present embodiment each include a side edge part 395*ba*1 in the vicinity of one end part 395*a* of the cleaning element 395 and a side edge part 395*ba*2 in the vicinity of the other end part 395*b* of the cleaning element 395. The respective side edge parts 395*ba*2 protrude in the axial direction of the roller 364 when compared with the respective side edge parts 395*ba*1. A plurality of slits 395*bc* are formed in each of the side edge parts 395*ba*2. The slits 395*bc* are formed to extend in the axial direction of the roller 364 and arranged at predetermined intervals in a direction in which the cleaning element 395 is wound. Further, the other end part 395*b* of the cleaning element 395 has a tip edge 395*bb* that is bent in shape. The tip edge 395*bb* is in a gull wing shape as a combination of a pair of arc shaped curves.

After the one end part 395*a* of the cleaning element 395 is fixed to the outer peripheral surface 364*a* of the roller 364 through the fixing portion F1 provided on the reverse surface of the one end part 395*a*, the cleaning element 395 is wound to the outer peripheral surface 364*a* of the roller 364 in the circumferential direction. The side edge parts 395*ba*2 in the vicinity of the other end part 395*b* of the cleaning roller 395, which protrude from the respective edges of the outer peripheral surface 364*a*, are bent inward in the radial direction of the roller 364 along respective end faces 364*c* of the roller 364 and are fixed to the respective end faces 364*c* of the roller 364 through the fixing portion F2 provided on the reverse surface of each side edge part 395*ba*2. It is noted that the respective side edge parts 395*ba*2 may be entirely or partly fixed to the respective end faces 364*c* of the roller 364.

The respective side edge parts 395*ba*2 in the vicinity of the other end part 395*b* of the cleaning element 395 in the present embodiment are fixed to the roller 364 having higher rigidity than the cleaning element 395. Thus, in the present embodiment, the both side edge parts 395*ba* in the other end part 395*b* of the cleaning element 395 can be fixed more firmly and stably than those in the first embodiment, and can accordingly have higher durability than those in the first embodiment.

Besides, the respective side edge parts 395*ba*2 in the vicinity of the other end part 395*b* of the cleaning element 395 are fixed to the respective end faces 364*c* of the roller 364, so as to be out of contact with the conveyance belt 324. Thus, the other end part 395*b* of the cleaning element 395 can hardly come off from the roller 364, and the cleaning roller 393 can have higher durability than the cleaning roller 363.

In addition, the respective side edge parts 395*ba*2 in the vicinity of the other end part 395*b* of the cleaning element 395 are fixed to the respective end faces 364*c* of the roller 364. This means the absence of the fixing portion F2 on the outer peripheral surface 364*a* of the roller 364. As a result, the difference between a width W' of the outer peripheral surface 364*a* of the roller 364 in the axial direction and the width W of the region of the cleaning element 395 which is to face the largest paper P can be set smaller than that in the first to third embodiments. Thus, the cleaning roller can be reduced in size.

Furthermore, in the present embodiment, the tip edge 395*bb* of the other end part 395*b* of the cleaning element 395 is bent in shape, and therefore can hardly rise up outward in the radial direction of the roller 364 with the other end part 395*b* of the cleaning element 395 fixed to the roller 364. Thus, the other end part 395*b* of the cleaning element 395 can be prevented from turning up.

The embodiments of the present disclosure have been described so far. However, the present disclosure is not limited to the embodiments shown in FIGS. 1-7C. The embodiments can be altered in various manners.

For example, the tip edge of the other end part of the cleaning element is in a shape of gull wing to prevent tuning up of the other end part of the cleaning element in the embodiments shown in FIGS. 6A, 6B, and 7A-7C. However, the shape of the edge of the other end part of the cleaning element that can prevent tuning up of the other end part of the cleaning element is not limited to the gull wing shape, and may be any other bent shape such as a V-shape, an arc shape, etc.

The cleaning roller is driven to rotate by a motor in the embodiments, but may be rotated by being driven by the conveyance belt.

The conveyance unit is moved to cause the cleaning roller to come in contact with and separate from the conveyance belt in the above embodiments. However, any other mechanism (e.g., a plunger) may cause the cleaning roller to come in contact with and separate from the conveyance belt.

The above embodiments have described the case where the present disclosure is applied to the belt cleaning device that cleans the conveyance belt through which the through holes are formed. However, the present disclosure is applicable to any belt cleaning device that cleans a conveyance belt through which no through hole is formed.

Further, the inkjet recording apparatus performs image formation on paper in the above embodiments. However, the inkjet recording apparatus may perform image formation on any recording mediums other than paper, such as a plastic sheet, cloth, etc.

Still further, the present disclosure is applied but not limited to the inkjet recording apparatus with the recording heads of line head type fixed to the apparatus casing. For example, the present disclosure can be applied to an inkjet recording apparatus with recording heads moving relative to the apparatus casing. In an example, the present disclosure can be applied to an inkjet recording apparatus with recording heads of serial type.

Yet further, the above embodiments have described the case where the present disclosure is applied to the image forming apparatus including the image forming section of inkjet recording type. However, the present disclosure is applicable to any image forming apparatuses including an image forming section of a type other than the inkjet recording type (e.g., an image forming apparatus including an electrographic image forming section).

Besides, the above embodiments can be altered in any other various manners within the scope not deviating from the gist of the present disclosure.

What is claimed is:

1. A belt cleaning device comprising:

a cleaning roller configured to clean a surface of a conveyance belt on which a recording medium is to be loaded, the conveyance belt conveying the recording medium, wherein the cleaning roller includes:

a roller having an outer peripheral surface; and a sheet-like cleaning element wound to the outer peripheral surface of the roller, and the cleaning element is wound to the outer peripheral surface of the roller plural times in the circumferential direction, so that the cleaning element can be wound and overlaid several times causing a thickness of layers formed by the cleaning element can be increased sufficiently in a diameter, one end part of the cleaning element thereof fixed to the roller, and both side edge parts of the other end part of the cleaning element are fixed at a part of the roller that is located thereof other than in a region thereof that is to face a possible largest recording medium.

2. A belt cleaning device according to claim 1, wherein in a state where the cleaning element is fixed to the roller, the cleaning element is formed such that a length in an axial direction of the roller increases from the one end part to the other end part and the both side edge parts in the other end part are each fixed at least partly to the roller.

3. A belt cleaning device according to claim 1, wherein in a state in which the cleaning element is fixed to the roller, the both side edge parts in the other end part of the cleaning element protrude in an axial direction of the roller and are each fixed at least partly to the roller.

4. A belt cleaning device according to claim 3, wherein the both side edge parts in the other end part are fixed to the roller with them recessed inward in a radial direction of the roller relative to the region.

5. A belt cleaning device according to claim 3, wherein a plurality of slits are formed in each of the both side edge parts in the other end part to extend in the axial direction of the roller and are arranged at predetermined intervals in a direction in which the cleaning element is wound.

6. A belt cleaning device according to claim 5, wherein the both side edge parts in the other end part are fixed to respective end faces of the roller.

7. A belt cleaning device according to claim 1, wherein the other end part of the cleaning element has a tip edge that is bent in shape.

8. A belt cleaning device according to claim 7, wherein the tip edge of the other end part of the cleaning element is in a gull wing shape.

9. A belt cleaning device according to claim 7, wherein the tip edge of the other end part of the cleaning element is in a V-shape.

10. A belt cleaning device according to claim 1, wherein the cleaning roller rotates in cleaning the conveyance belt in a direction that accords with a direction in which the cleaning element is wound to the roller.

11. An image forming apparatus comprising:

a conveyance belt configured to convey a recording medium;

a belt cleaning device including a cleaning roller configured to clean a surface of the conveyance belt on which the recording medium is to be loaded; and an image forming section configured to form an image on the recording medium, wherein the cleaning roller includes:

a roller having an outer peripheral surface; and a sheet-like cleaning element wound to the outer peripheral surface of the roller, and the cleaning element is wound to the outer peripheral surface of the roller plural time in the circumferential direction, so that the cleaning element can be wound and overlaid several times causing a thickness of layers formed by the cleaning element can be increased sufficiently in a diameter, one end part of the cleaning element thereof fixed to the roller, and both side edge parts of the other end part of the cleaning element are fixed at a part of the roller that is located thereof other than in a region thereof that is to face a possible largest recording medium.

12. An image forming apparatus according to claim 11, wherein the image forming section is of inkjet recording type.

13. A belt cleaning device comprising a cleaning roller configured to clean a surface of a conveyance belt on which a recording medium is to be loaded, the conveyance belt conveying the recording medium, wherein the cleaning roller includes:

a roller having an outer peripheral surface; and a sheet-like cleaning element wound to the outer peripheral surface of the roller, and the cleaning element is wound to the outer peripheral surface of the roller plural time in the circumferential direction, so that the cleaning element can be wound and overlaid several times causing a thickness of layers formed by the cleaning element can be increased sufficiently in a diameter, one end part of the cleaning element thereof fixed to the roller, and both side edge parts of the other end part of the cleaning element are fixed at a part of the roller that is located thereof other than in a region thereof that is to face a possible largest recording medium.

* * * * *